US005868148A

United States Patent [19]

Lindsey et al.

[11] Patent Number: 5,868,148

[45] Date of Patent: Feb. 9, 1999

[54] HAIR STYLER

[75] Inventors: Francis Lindsey, Stratford; Sergio Lopes Fernandes Da Costa, Danbury; Daniel Santhouse, Wilton, all of Conn.

[73] Assignee: Conair Corporation, Stamford, Conn.

[21] Appl. No.: 94,333

[22] Filed: Jun. 9, 1998

[51] Int. Cl.[6] ..... A45D 20/12

[52] U.S. Cl. ..... 132/271; 132/129; 34/97

[58] Field of Search ..... 132/211, 107, 132/112, 271, 272, 129, 229; 34/97, 98, 101, 68; 15/246.2, 344, 402, 405; 219/222, 225, 226, 227, 228, 229; 392/383

[56] References Cited

U.S. PATENT DOCUMENTS

| | | | |
|---|---|---|---|
| D. 365,685 | 1/1996 | Denebeim . | |
| D. 365,686 | 1/1996 | Denebeim . | |
| D. 366,152 | 1/1996 | Denebeim . | |
| D. 366,566 | 1/1996 | Denebeim . | |
| D. 374,776 | 10/1996 | Denebeim . | |
| 3,413,984 | 12/1968 | Tracy et al. . | |
| 3,835,869 | 9/1974 | Newman et al. . | |
| 3,843,990 | 10/1974 | Lardenois . | |
| 3,868,495 | 2/1975 | Dyer . | |
| 3,871,391 | 3/1975 | Boudal . | |
| 3,890,984 | 6/1975 | Lesetar . | |
| 3,955,065 | 5/1976 | Chambon . | |
| 4,291,714 | 9/1981 | Mariani . | |
| 4,295,283 | 10/1981 | Tomaro | 34/97 |
| 4,431,012 | 2/1984 | Brenn Albertoni . | |
| 4,502,496 | 3/1985 | Thomas et al. . | |
| 4,566,473 | 1/1986 | Hyman . | |
| 4,664,132 | 5/1987 | Schillig . | |
| 4,692,594 | 9/1987 | Martin | 219/222 |
| 4,759,135 | 7/1988 | Scivoletto | 34/97 |
| 4,934,855 | 6/1990 | Recchelbacher . | |
| 5,012,576 | 5/1991 | Johannesson . | |
| 5,060,398 | 10/1991 | Wilens | 34/97 |
| 5,091,630 | 2/1992 | Djuric | 219/222 |
| 5,373,607 | 12/1994 | Hwang . | |
| 5,479,951 | 1/1996 | Denebeim . | |
| 5,515,874 | 5/1996 | Denebeim . | |
| 5,765,575 | 6/1998 | Denebeim | 132/232 |

*Primary Examiner*—Gene Mancene
*Assistant Examiner*—Pedro Philogene
*Attorney, Agent, or Firm*—Ohlandt, Greeley, Ruggiero & Perle

[57] ABSTRACT

A hair styler for controlling the flow of air emitted from a hair blower, which comprises a coupler for attachment to the hair blower and having an internal chamber with a central axis and a plurality of vents, the hair styler having deflectors in the form of a plurality of canted vanes disposed in a turbinate arrangement exterior of the vents and about the central axis of the internal chamber, for deflecting air that exits the vents into plural flow paths which are approximately transverse to and about the central axis of the central chamber and which manifest different angular direction about the central axis.

27 Claims, 6 Drawing Sheets

A1
A2
CA
10
12
14
15
16
18
20
22
24
26
28
30
32
34
36
38
40
42
44
46
48
50
52
54
56
58
60
62
64
66
68
69
72
74
76
p
1
2
3

FIG. 11.
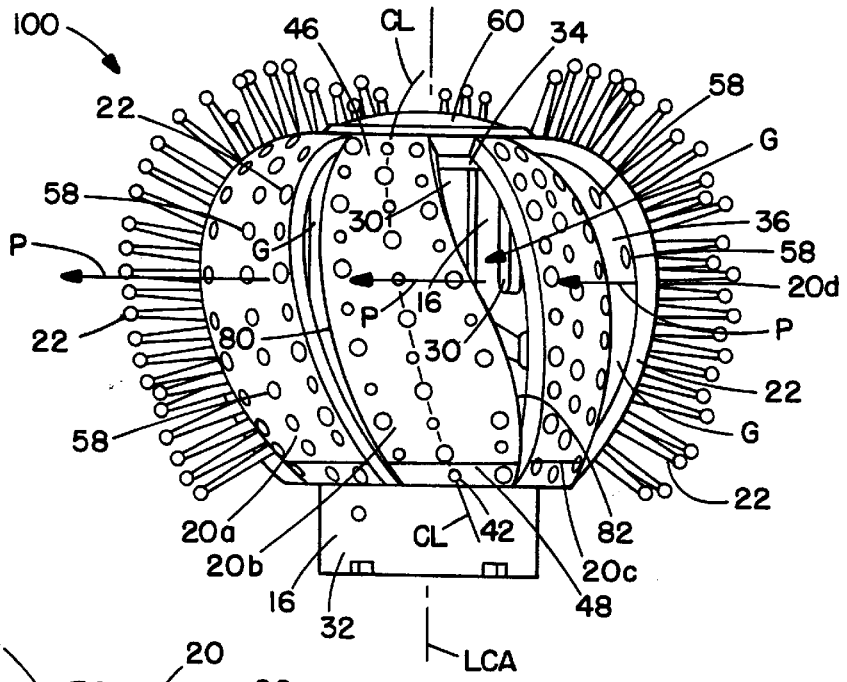
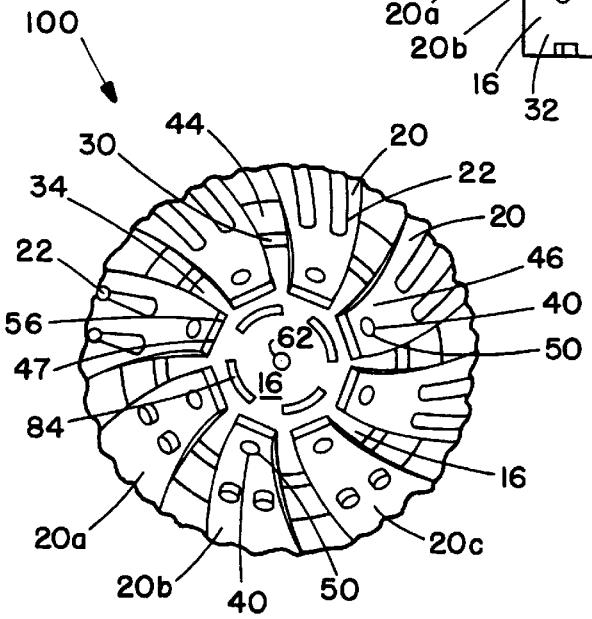
FIG. 12.
FIG. 13.
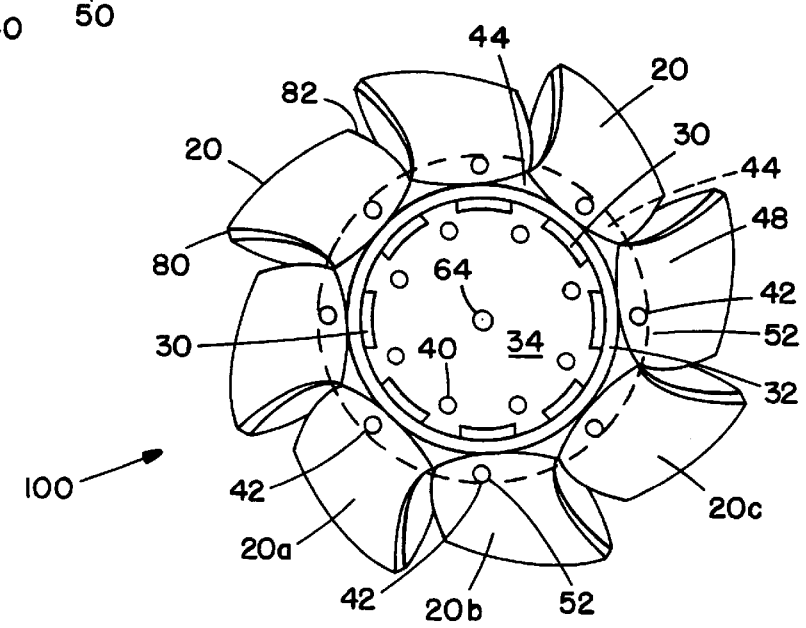

HAIR STYLER

FIELD OF THE INVENTION

This invention relates to air blowers for the hair. More particularly, this invention relates to a hair styler device for attachment to an air blower, for styling and drying hair.

BACKGROUND OF THE INVENTION

Air blowers, for example, hand-held hair blowers or dryers, typically have a cylindrical nozzle with a central axis for discharging air along the central axis in a mostly linear direction of flow to a limited focused area. This is effective for drying hair, but the air blower by itself is not utilizable for other hair grooming actions such as shaping, providing lift to and styling hair.

Recently, various hand-held hair brush and comb devices have been made available for separate use with hair blowers. Some of these are rounded or ball-shaped, are hollow and have bristles or prongs extending outward from their outer surfaces. The devices have round, or elongated openings or gaps in their outer surfaces. Air discharged from a hair blower held in one hand is directed at the outer surface of the hair brush held in the other hand, such that some air passes around the outer surface of the brush and some air enters the openings or gaps in one side of the brush and may exit through openings or gaps in another portion of the brush. These separately held hair brushes and combs are cumbersome in that they require the use of both hands to brush and manipulate the hair. While such hair brushes break up and distribute the flow of air discharged from the hair blower, air blown into and out of the brush is minimal.

More recently, a hair brush device has been provided for attachment to a hair blower. The attachment device is comprised of an elongated cylindrical metal tube which has holes in its outer surface. Bristles inside the tube extend outward through the openings in the tube's outer surface. Such an attachment device is an improvement over hand-held brushes because it frees-up one of the user's hands for use to manipulate the hair cooperatively with the device attached hair blower. Also, since air flow from the hair blower is discharged directly into the attachment, there is a much greater flow of air into and through the attachment than into and through the hand-held, separate hair brush. However, such attachment hair brushes have had the shortcoming that the air discharged through the holes in their cylindrical wall flows in paths which are radial and perpendicular to the axis of flow from the hair blower and to the axis of flow through the attachment device. This can result in an inefficient or limited use of the discharged air. For example, when hair strands are wrapped around the cylindrical attachment, much of the air so discharged through the holes of the attachment strikes the hair strands perpendicularly to their lie and in limited areas, and passes between the strands into the atmosphere. This tends to cause fly-aways, i.e., hair strands which are driven by the air flow to depart from or fly away from the cylindrical brush. Another shortcoming is that these cylindrical attachments are relatively limited in their capability to provide various hair grooming and styling functions. For example, the size of a curl provided to the hair is basically limited to the uniform diameter of the cylindrical tubular attachment. Also, since most of the air exits the device in radial paths which are perpendicular to the axis of flow through the cylinder, their capability of styling the hair in a variety of waves, flips and shapes and of providing increased lift and volume to the hair is limited.

It would be desirable to provide attachment devices for hair blowers, especially attachment devices having, rounded, or ball-like shapes, which would provide varied hair styling capabilities. However, forming such rounded, ball-like brush or comb attachment devices of metal can be difficult and expensive. Although it would be desirable to form such devices of more easily-formable and less expensive materials such as polymeric or elastomeric materials, the high temperatures of approximately 120° C. generated internally in such devices when attached to hot air hair blowers could soften or melt such materials.

Prior designs of separately held, rounded or ball-type brushes and comb devices made of non-metal materials would not be suitable for attachment devices for hot air hair blowers. Although they have gaps in their surfaces which would allow some air to exit the devices, the gaps were designed for aesthetic purposes and would allow little air to exit the devices. Large quantities of hot air delivered from a hot air hair blower directly into the device could not be exhausted rapidly enough. There would be an excessive build up of internal hot air and internal temperatures which could soften or melt non-metal materials of the device. Even if these devices or attachment devices were made of metal, the excessive buildup of hot air in the device would tend to resist the hair blower's air fan and could cause the hair blower to overheat.

It would be desirable to provide a hair styler attachment device for air blowers, especially hot air hair blowers, which could be made of polymeric or elastomeric materials, to provide rounded or ball-type shapes which would permit the styling of hair with the aforementioned variety of shapes and increased lift and volume, and yet which would rapidly exhaust air and avoid excessive build up internal temperatures in the device.

SUMMARY OF THE INVENTION

It is an object of this invention to provide a hair styler which is attachable to an air blower, for example, to a hand-held hot air hair blower such as a hair dryer, and which overcomes one or more of the above and other shortcomings of current hand-held hair brushes or combs and hair brush or comb attachment devices.

Another object of this invention is to provide such a hair styler which provides a more efficient use of the air discharged from the air blower.

Another object of this invention is to provide an aforementioned hair styler which discharges air in plural flow paths approximately transverse to and manifesting different angular directions about the axis of air flow through the hair styler.

Another object is to provide an aforementioned hair styler which discharges air along the aforementioned flow paths and thereby provides the capability of styling hair in various waves, flips and/or shapes.

Another object of this invention is to provide an aforementioned hair styler which has an outer surface of varied dimension to permit the formation of a variety of shapes and curls of different sizes to the hair.

Another object is to provide an aforementioned hair styler which tends to discharge air generally along, rather than perpendicularly against and through, hair strands in contact with or wrapped to various extents around the hair styler.

Another object is to provide an aforementioned hair styler which reduces fly-away hair strands and tends to keep hair strands within the prong area of the hair styler for increased styling capability.

Another object of this invention is to provide an aforementioned hair styler which provides more lift and volume to hair styled by use of the hair styler, than to hair dried by use of current hair brushes and hair brush attachments.

Another object of this invention is to provide an aforementioned hair styler which is designed to rapidly and efficiently discharge air therefrom and therefore can be made of polymeric or elastomeric materials.

Yet another object of this invention is to provide an aforementioned hair styler having a turbinate design comprised of an array of vanes angularly disposed about the axis of air flow through, or about the central axis of, the internal chamber of the hair styler.

The above and other objects and advantages are provided by the hair styler of this invention, which is for controlling a flow of air emitted from a hair blower, and which comprises: coupler means for attachment to the hair blower and which, when so attached, is aligned to receive air emitted along an axis of flow of the hair blower, and deflector means associated with the coupler means for deflecting the air that flows through the coupler means into plural flow paths exterior of the hair styler, the plural flow paths being approximately transverse or perpendicular to and about the axis of flow, and manifesting different angular directions about the axis of flow. The exterior plural flow paths are approximately perpendicular to the central axis of the internal chamber, and manifest different angular directions about the central axis of the internal chamber. The different angular directions can be approximately tangential to the hair styler.

The coupler means preferably includes a core which includes an internal chamber having an entrance, a central axis for receiving along the central axis air emitted from the hair blower, and vents to allow air to exit the internal chamber. The deflector means can include a deflector in the internal chamber, preferably a blind end wall, for deflecting air exiting through the vents into flow paths which are approximately perpendicular to the axis of flow The deflector means preferably includes canted vanes connected to the coupler means, and spaced from each other and disposed about the axis of flow or about the central axis of the central chamber, preferably exterior of the vents, for deflecting the air exiting the vents into the plural flow paths.

The vanes have an exterior surface with a plurality of elongated members, preferably prongs, extending outwardly therefrom for manipulating the hair, and an interior surface which is disposed at a non-perpendicular angle to a line drawn approximately perpendicular to the axis of flow or to the central axis of the internal chamber, the angle being seen when the vanes are viewed in section taken perpendicularly through and across a width dimension of the vanes. The vanes are disposed adjacent one another such that the air deflected from one vane flows over and preferably through the prongs of an adjacent vane, and they are spaced from one another to allow some of the air exiting the vents to be discharged from the hair styler through the spaces between the vanes.

The vanes preferably are elongated, and when mounted onto the coupler means or core, they are disposed longitudinally along and generally parallel to the central axis of the internal chamber of the coupler means or core, such that the vanes have a front end distal to the entrance end of the internal chamber, and a back end proximate to the entrance end of the internal chamber. The vanes have an interior surface which is concavely shaped, preferably conically shaped toward the front ends of the vanes and relative to the internal chamber, when the vanes are viewed in section taken vertically through and along the length of the elongated vanes.

The vanes have a leading edge facing in the direction of the air flow deflected from the vanes, and a trailing edge opposite the leading edge, the leading edges of the vanes being more removed from the central axis of the internal chamber than are the trailing edges of the vanes.

The vanes preferably have a longitudinal center line which is curved. The center line intersects the central axis of the internal chamber. Portions of the leading and trailing side edges of the vanes can be curved in general correspondence with the curve of the center lines of the vanes.

The exterior of a portion of the hair styler formed by the vanes is generally in the shape of a segment of a circle, such that the leading edges of the vanes are disposed along the periphery of the segment of the circle and the trailing edges of the vanes are disposed radially interior of the segment of the circle.

Preferably, the vanes are disposed in a turbinate arrangement about the central axis of the internal chamber, and the vanes are made of an elastomeric material.

The hair styler has an internal chamber having a central axis for receiving in a path along the central axis, air emitted from the hair blower; means disposed in the internal chamber for changing the path of the air received along the central axis and causing the air to flow in paths which are substantially transverse to the central axis of the internal chamber; and an array of vanes which are disposed in a turbinate arrangement about the central axis of the internal chamber, the vanes being disposed at a non-perpendicular angle to and in the paths of the air traveling in the substantially transverse flow paths, such that the air which impinges on the vanes is directed to flow in plural flow paths exterior of the vanes which are substantially transverse to, and angular about the central axis of the internal chamber.

BRIEF DESCRIPTION OF THE DRAWINGS

FIG. 11 is a front elevational view with portions broken away of the hair styler of FIGS. 8–10.

FIG. 12 is a top view, with portions broken away, of the hair styler of FIG. 11.

FIG. 13 is a bottom view, with portions not shown, of the hair styler of FIG. 11.

DETAILED DESCRIPTION OF THE INVENTION

Figure 1:
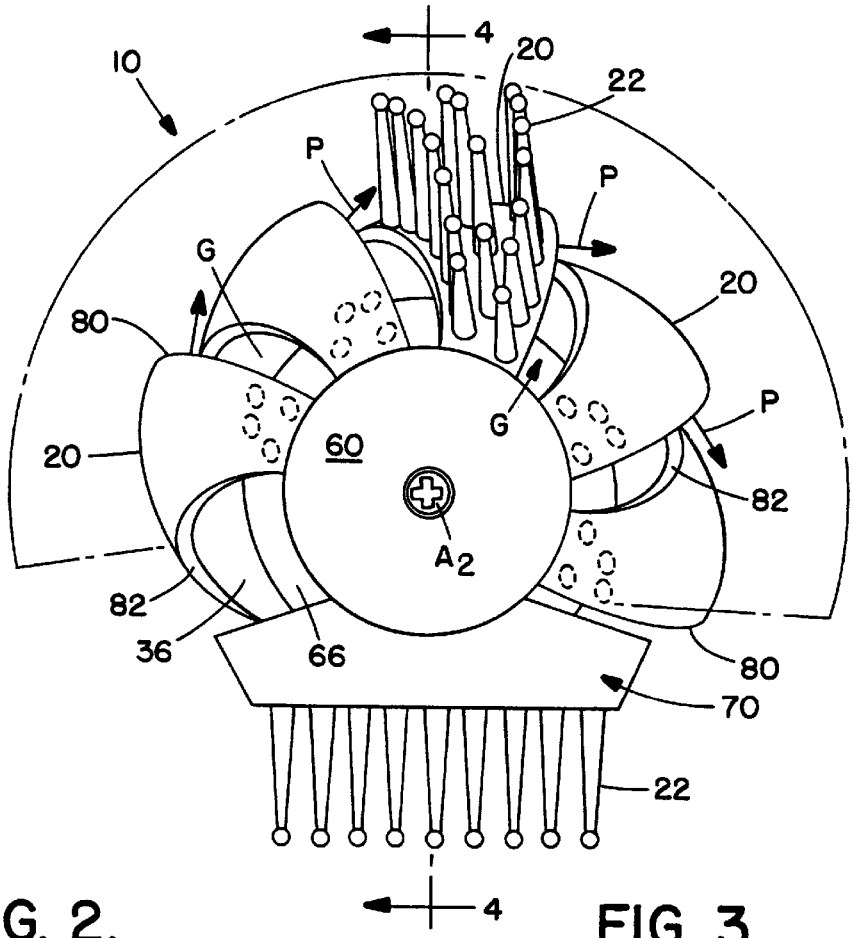
FIG. 1 is a front elevation of a preferred embodiment of the hair styler of this invention, as would be seen along line 1—1 of FIG. 4.
Figure 2:
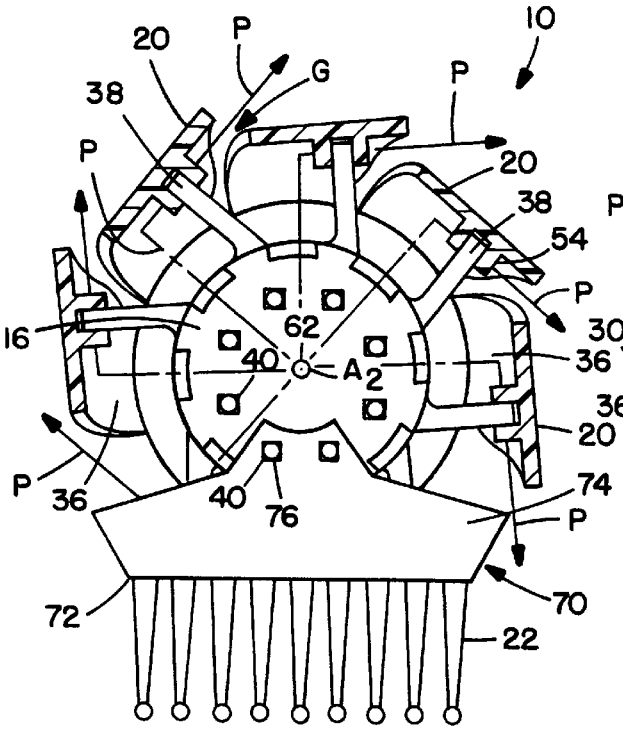
FIG. 2 is a front view, partly in vertical section and partly in elevation, of the hair styler shown in FIG. 1 with its front overcap removed, as would be seen along line 2—2 of FIG. 4.
Figure 3:
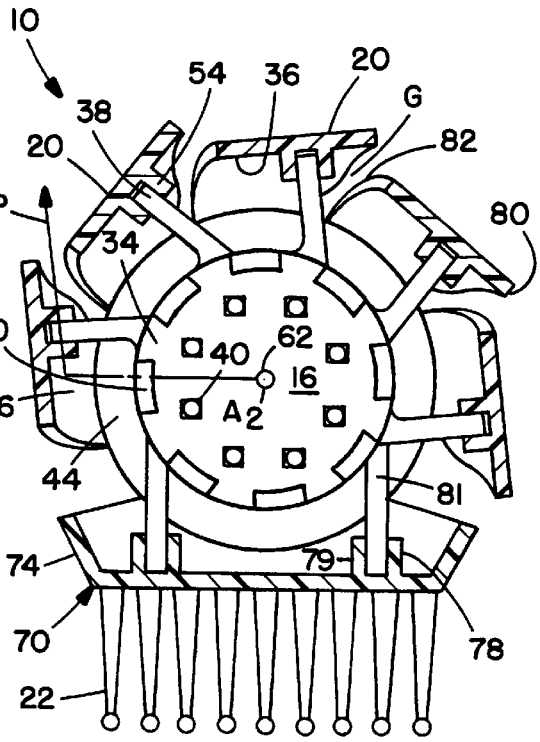
FIG. 3 is a vertical sectional view through the hair styler of FIG. 1, and as would been seen along line 3—3 of FIG. 4.
Figure 4:
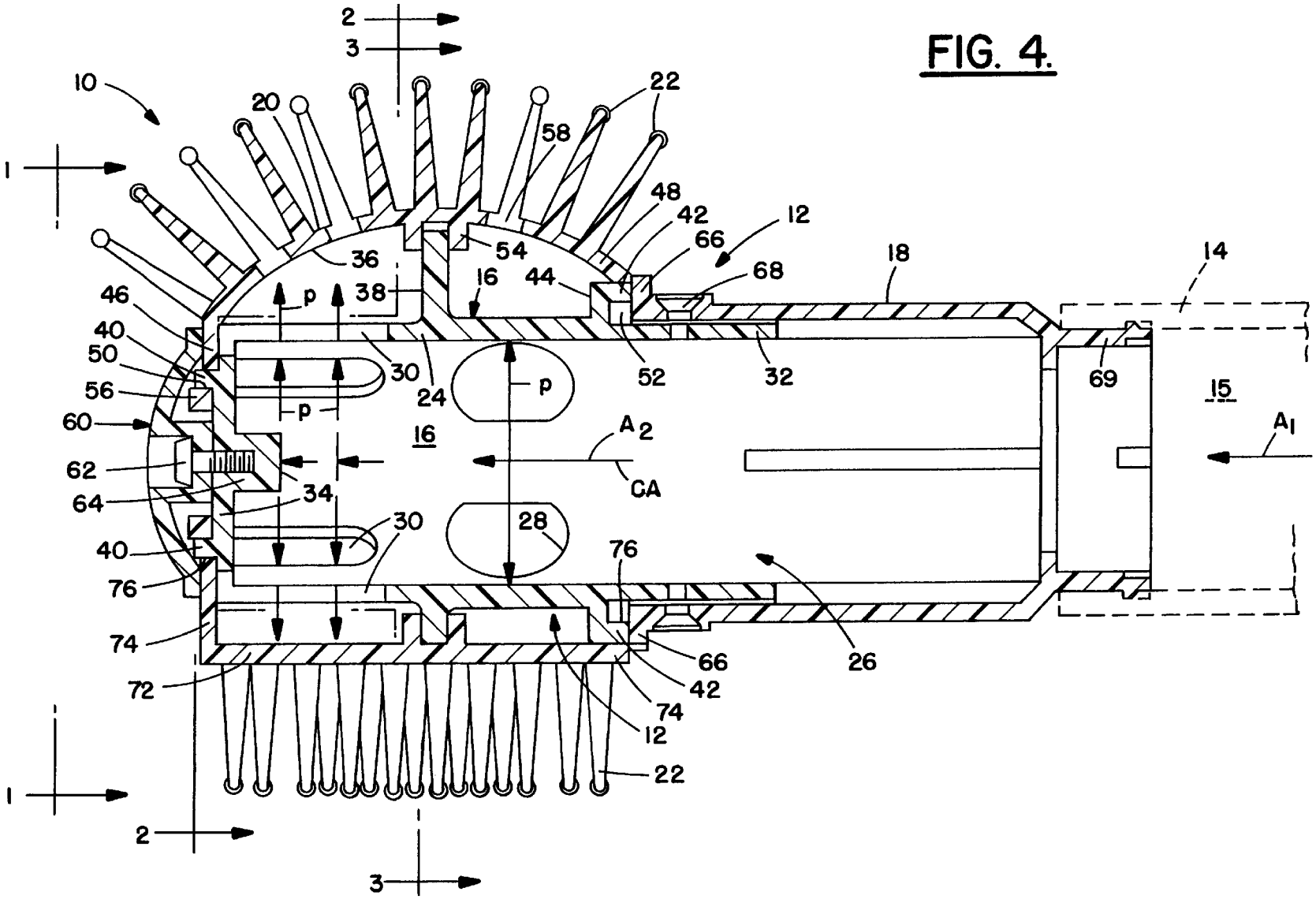
FIG. 4 is a vertical sectional view as would been seen basically along line 4—4 of FIG. 1.

FIGS. 1 through 7 show the preferred embodiment of the hair styler of the invention, generally designated 10, for controlling a flow of air emitted from a hair blower. As shown in FIG. 4, a vertical sectional view as would be seen basically along line 4—4 of FIG. 1, hair styler 10 is comprised of coupler means, generally designated 12, for attachment of hair styler 10 to an outlet 14 of a hair blower 15 (each partly shown in dashed lines), and, when so attached, for alignment therewith to receive air emitted axially, i.e. along an axis of flow, designated Al, from hair blower 15. As shown in FIG. 4, coupler means 12 includes a core 16, and a connector, here, sleeve 18 for joining core 16 to hair blower outlet 14. Hair styler 10 is also comprised of deflector means associated with, preferably part of, the coupler means, for deflecting the air that flows through the coupler means, particularly through core 16, into plural flow paths, generally designated P, exterior of hair styler 10. As shown in FIGS. 1–3, flow paths P are approximately transverse to and extend about the axis of air flow received from the hair blower, such axis of air flow in core 16 being represented as $A_2$. As shown, axis of flow $A_2$ corresponds to axis of flow $A_1$, and references herein to axis of flow $A_2$ will be understood to include axis of flow $A_1$. Plural flow paths P exiting hair styler 10 manifest different angular directions about axis of flow $A_2$. The deflector means of the invention preferably include a plurality of canted, preferably elongated, vanes 20, spaced from each other and disposed about axis of flow $A_2$. Vanes 20 are disposed generally along the length of core 16 and have a plurality of elongated members, such as prongs 22, formed on and/or extending outwardly therefrom, for manipulating, e.g. styling hair. For simplification, prongs 22 are not shown in FIGS. 2 and 3. Flow paths P are deflected from one vane over an adjacent vane, and preferably through prongs 22 of the adjacent vane.

Figure 8:
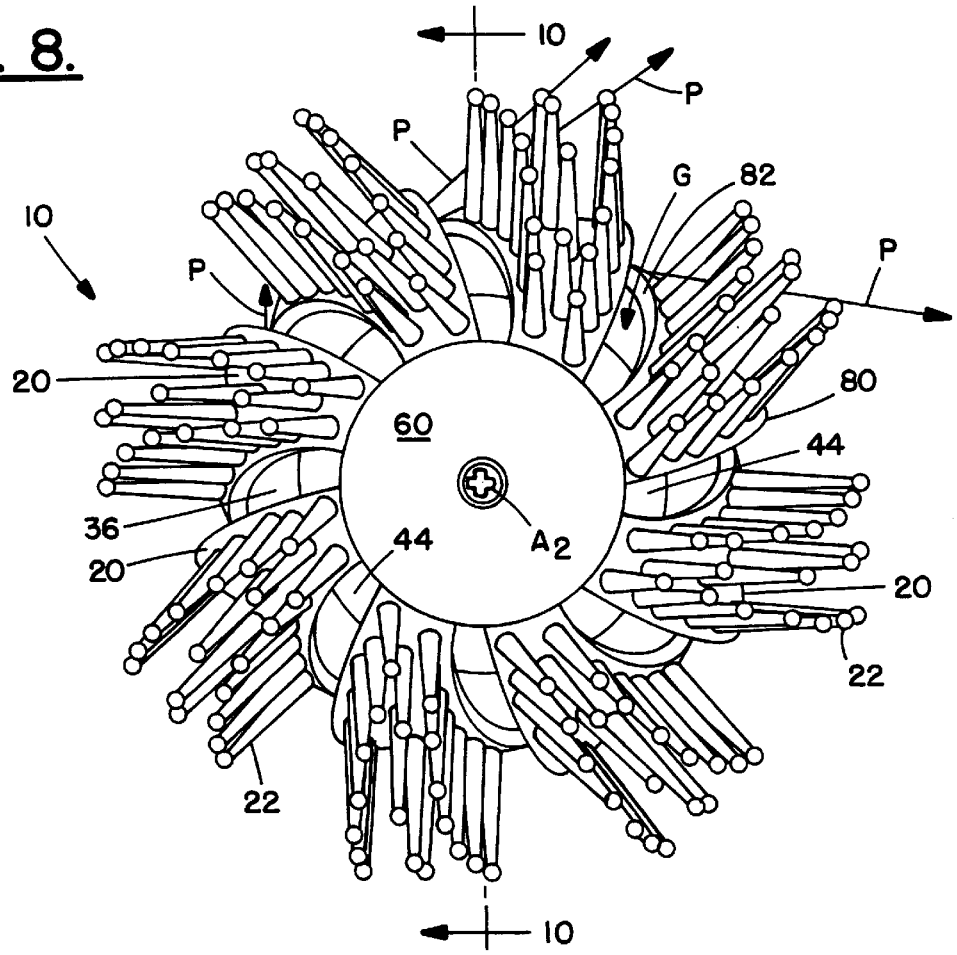
FIG. 8 is a front elevational view of an alternative embodiment of the hair styler of this invention, as would be seen along line 8—8 of FIG. 10.
Figure 9:
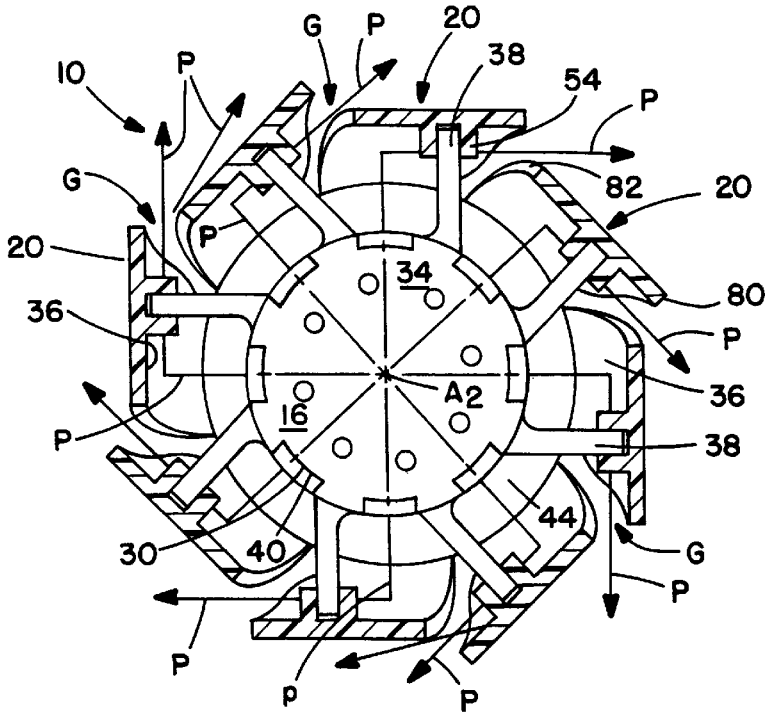
FIG. 9 is a vertical sectional view through the hair styler of FIG. 8, and as would be seen along line 9—9 of FIG. 10.

As shown in FIGS. 1–3, and for the alternate embodiment shown in FIGS. 8 and 9, vanes 20 have an interior surface 36 which is disposed at an angle, when the vanes are viewed in section taken perpendicularly through and across their width dimension, as they are viewed in FIGS. 2 and 3. Preferably, vanes 20 are disposed about axis of flow $A_2$, at a non-perpendicular angle to a line drawn approximately perpendicular to such axis of flow. Preferably, vanes 20 are disposed about core 16 or internal chamber 26 at a non-perpendicular angle relative to internal chamber 26, or its central axis CA, which here corresponds to axis of flow $A_2$. In connection with the embodiments shown, references hereinafter to central axis CA also refer to axis of flow $A_2$.

FIGS. 1–3 and 8 and 9 show that vanes 20 are disposed in a turbinate arrangement about central axis CA of internal chamber 26, in the paths of the air exiting internal chamber 26, through vents 28, 30, in flow paths p which are approximately transverse or perpendicular to central axis CA of internal chamber 26. The air impinging on interior surfaces 36 of vanes 20 is deflected and directed to flow exterior of vanes 20 in plural flow paths which are approximately transverse or perpendicular to, and manifest different angular or tangential directions about central axis CA of internal chamber 26. Vanes 20 are spaced from one another and have gaps G therebetween, which allow some of the air exiting vents 28, 30 to be discharged through spaces or gaps G.

Referring more particularly to FIG. 4, coupler means 12, here elongated core 16, has an elongated cylindrical wall 24 which defines an internal chamber 26 having a central axis CA for receiving air emitted from hair blower 15. Coupler means 12 is for attachment of internal chamber 26 to hair blower 15. Internal chamber 26 has a plurality of vents therethrough, here shown as arcuate vents 28 and elongated vents 30, to allow air received from hair blower 15 to exit chamber 26. Core 16 has a back, entrance end 32 which defines an entrance for receiving air from hair blower 15, and a front end opposite entrance end 32 and defined in part by wall 34, here shown as a blind end wall. Wall 34 serves as deflector means in chamber 26 for deflecting air received along central axis CA from hair blower 15. Broadly, wall 34 serves as means for changing the path of the received air and causing the air to flow in paths substantially transverse or perpendicular to central axis CA. Wall 34 blocks the received air and builds up a back pressure of air in internal chamber 26, which accelerates the air out of vents 28, 30. Thus, wall 34 deflects the air received from blower 15 out of core 16 through vents 28, 30 in paths p which are approximately transverse or perpendicular to central axis CA of internal chamber 26. As shown in FIGS. 1–4, in the preferred embodiment, vanes 20 are disposed exterior of internal chamber 26, particularly exterior of vents 28, 30, for deflecting the air exiting the vents into plural flow paths P.

Coupler means 12, including core 16, preferably include means for mounting vanes 20 thereon such that the vanes extend generally along the length of core 16 and are disposed exterior of vents 18, 20 for deflecting the air exiting the vents. The air exiting vents 18, 20 in paths p impinges on interior surfaces 36 of vanes 20 and is deflected into and discharged from hair styler 10 in plural flow paths P. The means for mounting vanes 20 onto core 12 include a plurality of mounting members, here shown as an array of arms 38 which extend generally radially outward from a central area of the length of exterior surface of core 16, a circular array of pins 40 extending axially forward from the front surface of front wall 34, and a circular array of pins 42 extending axially rearward from vertical annular flange 44 located adjacent entrance end 32 of core 16.

FIG. 4 shows that, when vanes 20 are seen in section taken vertically through and along their length, vanes 20 and their interior surface 36 are concavely shaped relative to internal chamber 26 of core 16.

Figure 5:
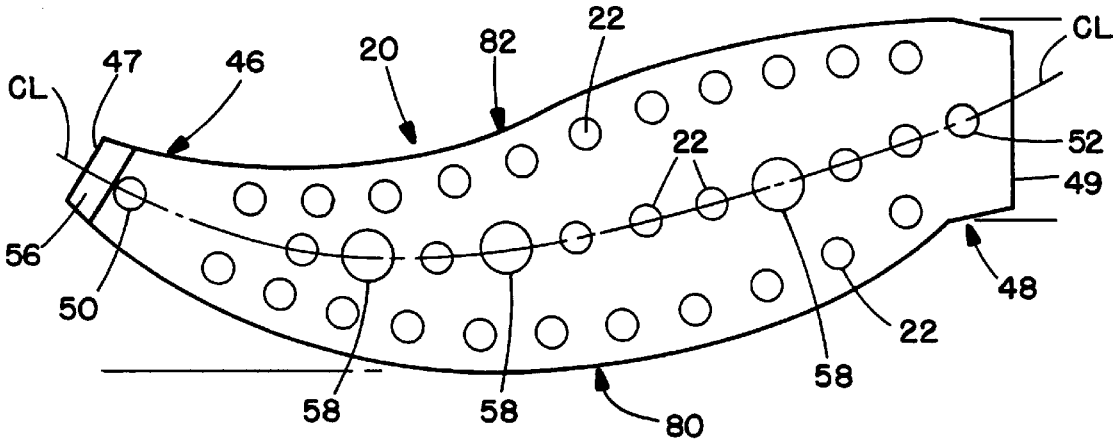
FIG. 5 is a top plan view of a vane employed in the hair styler of this invention.
Figure 6:
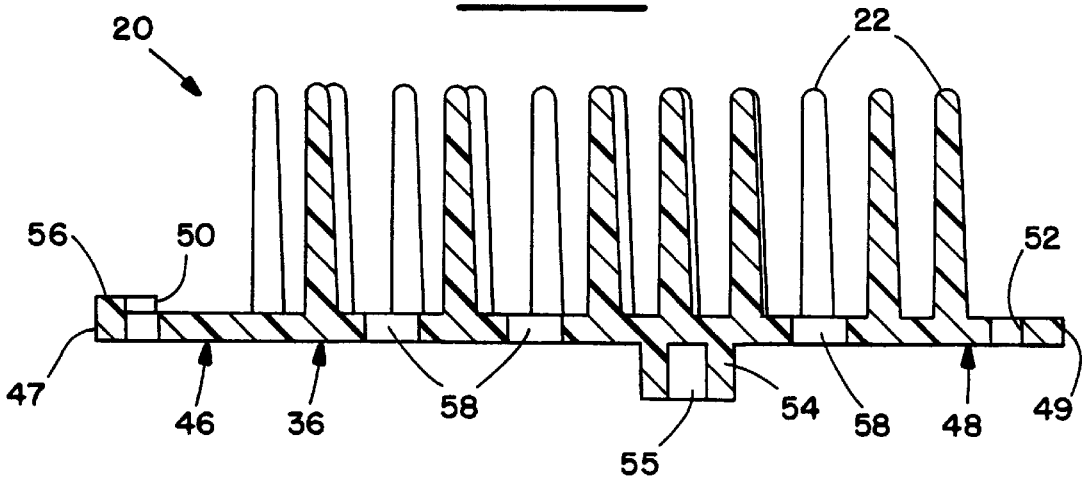
FIG. 6 is a side elevation view of the vane of FIG. 5.
Figure 7:
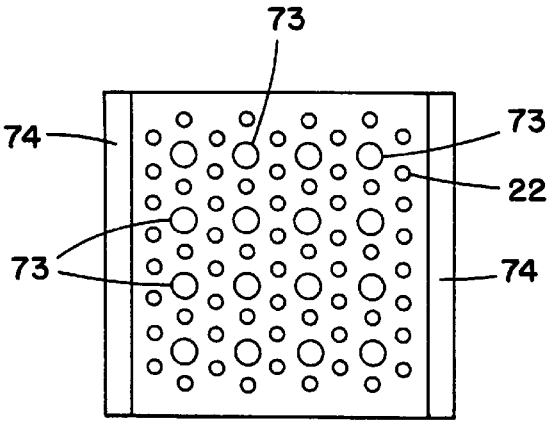
FIG. 7 is a bottom plan view of the styling plate shown in at the bottom of the hair styler shown in FIG. 1.

As shown in FIGS. 5 and 6, vanes 20 preferably are normally flat members. Vanes 20 have a front end 46 with an opening 50 adapted to receive a pin 40, a back end 48 with an opening 52 to receive a pin 42, a rib 56 extending outwardly and upwardly from the exterior surface of front end 46 for rigidifying that end of the vane and facilitating its mounting onto a pin 40, and an interior surface 36 having an outwardly extending annular wall 54 defining a socket 55 for tightly receiving and frictionally holding the end of an arm 38 of core 16. Vanes 20 also have holes 58 extending through the vanes for allowing some of the air exiting vents 28, 30 to be discharged from hair styler 10 through holes 58.

FIG. 5 shows that vanes 20 have a center line CL that is curved, and that front end opening 50 and back end opening 52 are on center line CL, but they are not in direct linear alignment with each other. FIG. 5 shows that front end edge 47 is at an angle relative to back end edge 49, which is disposed vertically to the length of vane 20. FIG. 5 also shows that vanes 20 have side edges 80, 82 which are curved and generally correspond to the curved configuration of center line CL. Side edges 80, 82 are elsewhere herein respectively referred to as leading side edge 80 and trailing side edge 82.

FIGS. 1–3, 8, 9, 11 and 13, show that when vanes 20 are mounted, preferably bent, twisted and mounted, onto core 16, side edge 80 is disposed as leading side edge 80 facing in the direction of air flow deflected from vanes 20, and side edge 82 is disposed as trailing side edge 82 opposite leading side edge 80. Leading side edges 80 of vanes 20 are more removed from central axis CA of internal chamber 26 than are trailing side edges 82. Thus, the disposition of vanes 20 is such that the general shape of at least a portion of hair styler 10 and 100 of this invention is circular or is a segment of a circle, such that leading side edges 80 of the vanes are disposed along and form the periphery or a segment of the periphery of the hair styler, and trailing side edges 82 are disposed radially interior of the periphery or segment of the periphery of the hair styler.

Vanes 20 are substantially rigid, but they are flexible enough that they can be bent into an arcuate, concave shape relative to core 16, and they can be twisted, if desired, and mounted, attached or connected to core 16 at their respective front and back ends. Vanes 20 can be mounted onto core 16 in the following manner. Vane 20 is pushed downwardly to seat the end of an arm 38 of core 16 firmly in socket 55 of annular wall 54. Then, front end 46 of vane 20 is bent over and pushed axially rearward onto a pin 40 such that a pin 40 enters front opening 50, and likewise back end 48 is bent over and pushed axially forward to insert a pin 42 into back opening 52. This is repeated for each of the vanes. See FIGS. 12 and 13 which show, for both the preferred and alternate embodiments of the hair styler of this invention, a plurality of vanes 20 mounted onto pins 40 and 42. Briefly, FIG. 12 shows vane front ends 46 mounted on pins 40, and FIG. 13 shows back ends 48 of vanes 20 (without prongs) mounted on pins 42. As shown in FIGS. 1, 4, 8 and 11, front ends 46 of vanes 20 are maintained in their mounted positions on pins 40 by a front overcap 60 which fits over vane front ends 46 and is fastened to core front wall 34 by a screw 62 fastened into a threaded recess 64. As shown in FIG. 4, back ends 48 of vanes 20 are maintained in their mounted positions on pins 42 by the forward surface of annular flange 66 extending radially outward from the end of sleeve 18, sleeve being fastened at its forward end to core entrance end 32 by screws 68. Sleeve 18 has a narrow diameter collar 69 at its opposite, back end which fits within and can be fastened by screws (not shown) to outlet 14 of hair blower 15.

As shown in FIGS. 1–4 and 7, the preferred hair styler 10 includes a styling plate 70 mounted onto core 16 such that it lies tangential to the lower cylindrical outer surface of core 16. Styling plate 70 is comprised of a substantially flat bottom wall 72 having holes 73 therethrough (see FIG. 7) and elongated members, here, prongs 22, extending outwardly from its lower surface. Bottom wall 72 communicates at its outer extent with an integral, upstanding surrounding rim 74. Rim 74 is substantially vertical at its front and back portions, and is disposed at an outward acute angle relative to wall 72 along its side portions. The front and rear rim portions each have a pair of openings 76 therein for respectively receiving pins 40 and 42. Styling plate 70 has a pair of annular walls 78 extending upwardly therefrom and each defining an upwardly extending socket 79 which tightly receives and frictionally holds the end of a leg 81 extending from core 16. As in the case of vanes 20, styling plate 70 is maintained mounted on pins 40 by front overcap 60 and by flange 66 of fastened sleeve connector 18.

Styling plate 70 serves as deflector means exterior of core 16. Some of the air which exits vents 28, 30 is deflected by the side portions of rim 74 and is discharged from hair styler in flow paths P which, as previously stated, are substantially transverse to and manifest in different angular directions about central axis CA. Styling plate 70 adds versatility to hair styler 10 by providing it with a flat perpendicular member with prongs for brushing and combing hair.

FIGS. 8–13 are views similar to FIGS. 1, 3 and 4, but show an alternative embodiment of the hair styler of this invention wherein the hair styler, generally designated 100, has vanes 20 disposed entirely, rather than only partly about core 16. Elements of hair styler 100 shown in FIGS. 8–13 which are the same as those of hair styler 10 shown in FIGS. 1–6, are given the same reference numbers.

Figure 10:
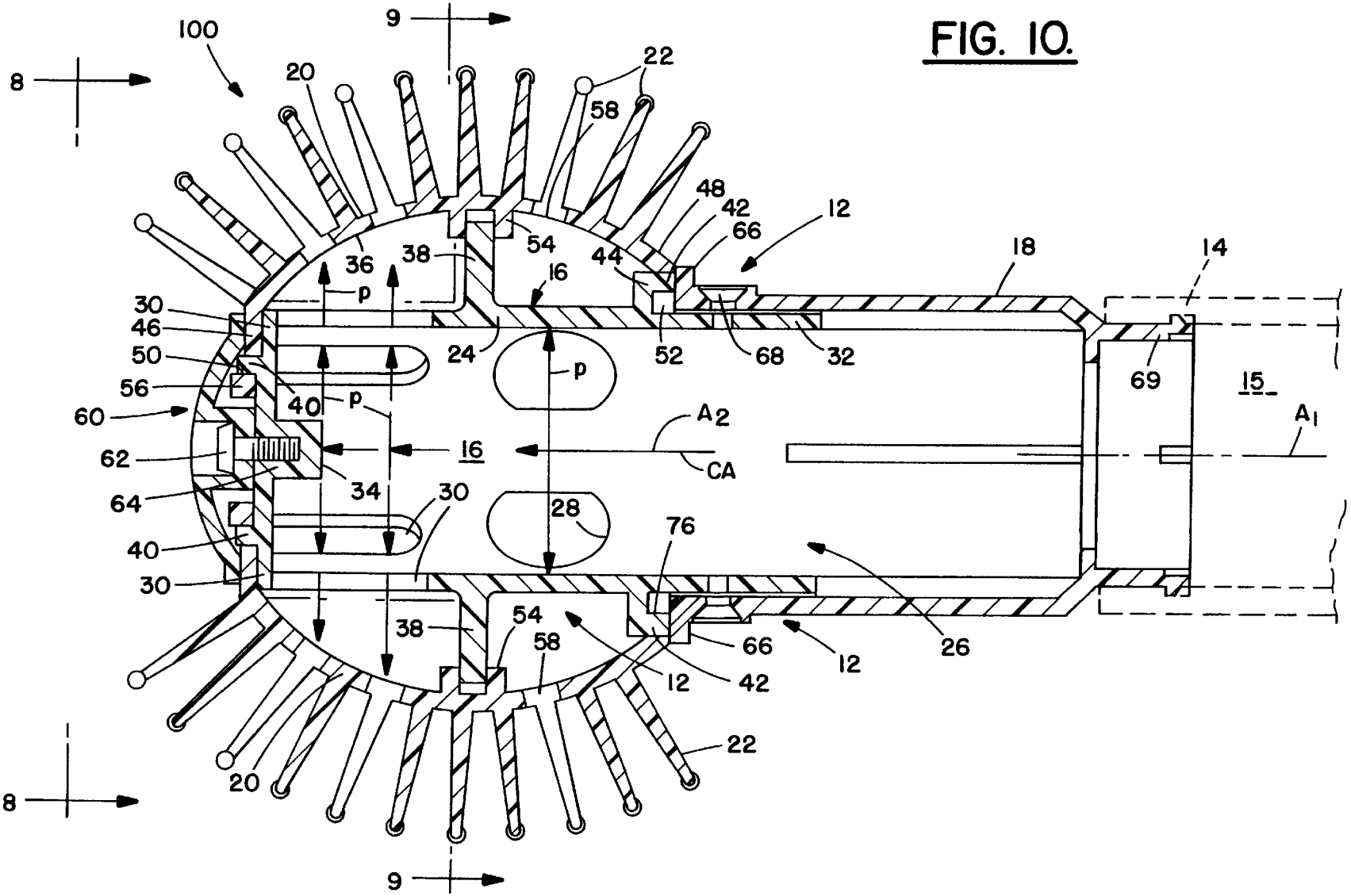
FIG. 10 is a vertical sectional view as would be seen basically along line 10—10 of FIG. 8.

FIGS. 8–10 show that instead of styling plate 70 which was employed with hair styler 10, hair styler 100 employs three more vanes 20, such that vanes 20 are spatially disposed about the entirety of core 16, and that plural flow paths P which are approximately transverse or perpendicular to central axis CA of core internal chamber 26, manifest in different angular directions entirely about central axis CA. As shown in FIGS. 9 and 10, the three additional vanes are disposed about, mounted onto and retained on core 16 and function in the same manner as previously explained with respect to the other vanes 20 of preferred hair styler 10.

FIG. 11 is a front elevational view of hair styler 100 with sleeve connector 18 removed, and with prongs 22 of three vanes 20*a*, 20*b*, and 20*c* cut off at their base to more clearly show the profiles, spatial relationships, disposition, turbinate arrangement and characteristics of vanes 20, as they are mounted both on hair styler 100 and on hair styler 10. It will be understood that the disclosure presented here in connection with FIG. 11 and below in connection with FIGS. 12 and 13 as to hair styler 100, also applies to hair styler 10. FIG. 11 shows that vanes 20 are elongated and, when viewed from their exterior, they are disposed generally longitudinally along and generally parallel to longitudinal central axis LCA of hair styler 100 and to central axis CA of internal chamber 26, and that the longitudinal center line CL of vane 20*b* facing the reader, and the center lines of all of vanes 20, including vanes 20*a* and 20*c*, are curved. Vane center lines CL angularly intersect longitudinal central axis LCA and central axis CA. Accordingly, portions of the upper ends of the vanes, previously referred to as front ends 46, are offset to the left of, and portions of the lower ends of the vanes, previously referred to as back ends 48, are offset to the right of, longitudinal axis LCA of hair styler 100, and likewise to the left and right of central axis CA of interior chamber 26. FIG. 11 shows that side edges 80, 82 of vanes 20 are curved, and generally correspond to the curve of their respective center lines CL such each vane has a width which varies generally along its length. FIG. 11, as well as FIGS. 1 and 8 show that, when mounted, the vanes preferably are twisted along their lengths and widths. These features provide spaces or gaps G of varying widths and radial extents along and between side edges 80, 82 of mounted adjacent vanes. Thus, gaps G between lower back ends 48 of adjacent vanes 20*a*, 20*b* and 20*c* are relatively narrow and progressively circumferentially and radially widen between portions of adjacent vanes, as the gaps extend toward their upper, front ends 46, where they again narrow.

FIG. 11 shows that vanes 20 are concavely, preferably approximately conically, shaped relative to core 16, to internal chamber 26 or to its central axis CA. Portions of the inner surfaces 36 of vanes 20 located toward their upper front ends 46, adjacent the two upper openings 58, are more spatially removed from core 16 than are other portions of interior surface 36 of vanes 20. Some of the air which exits vents 28, 30 is discharged from hair styler 100 directly through gaps G, and a lesser amount of the exiting air is discharged through vane holes 58. FIG. 11 further shows that portions of concavely shaped interior surface 36 of vanes 20 are comprised of arcs formed by a plurality of radii of differing lengths extending from axes CA and LCA, or from the outer surface of core 16. Consistent with the conical shape of interior surfaces 36 of vanes 20, the portions of interior surface 36 of vanes 20 adjacent upper holes 58 toward upper ends 46 of vanes 20, are formed by one or more radii which are longer than radii forming portions of the interior surface which are near lower, back ends 48 of vanes 20.

FIG. 12 is a top plan view of hair styler 100 shown in FIG. 11 with front overcap 60 removed, thereby exposing the front surface of core wall 34, and showing how vanes 20 are mounted onto pins 40 which extend axially forward from core wall 34. FIG. 12 shows in its central portion, guide walls 84 which appear as segments of a circle, extend axially forward from the front surface of core wall 34, and guide and align vane front ends 46 as they are mounted onto pins 40. As shown in FIG. 11, front ends 46 of vanes 20 are maintained in their mounted positions on pins 40 by front overcap 60 when it is secured to core front wall 34, thereby retaining vane front ends 46 between overcap 60 and wall 34. FIG. 12, along with FIGS. 1, 8 and 11, show that gaps G are narrow between vane front ends 46 and the gaps increase in extent further along the lengths of vanes 20.

FIG. 13 is a bottom view of hair styler 100 shown in FIG. 11, but with prongs 22 of FIG. 11 not shown. More particularly, FIG. 13 shows how vane back ends 48 are mounted on pins 42 extending axially to the rear of core annular flange 44. Back end edges 49 of vanes 20 are near or touch the outer surface of core entrance end 32. FIGS. 12 and 13, considered together, show that, with respect to vane 20*b*, core front pin 40 (dashed lines in FIG. 13) and core back end pin 42 are not axially aligned, and that vane front end opening 50 and vane back end opening 52 are not axially aligned. This applies to all vanes 20. These Figures confirm that center line CL of vanes 20 which passes through vane openings 50, 52 is curved because, as shown in FIG. 11, pin 42 on which back end opening 52 of vane 20*b* is mounted is offset to the right of the pin 40 on which front end opening 50 of vane 20*b* is mounted.

The turbinate design of the hair styler of this invention exhausts hot air rapidly and efficiently from the interior of the hair styler. The turbinate design is an array of vanes spaced from and adjacent each other, and arranged about the axis of flow of air through, or arranged about the central axis of, the internal chamber of the hair styler, comparable in some respects to an arrangement of vanes of a turbine. The turbinate design and the features and disposition of the vanes of the invention provide a large hot air exhaust area, approximately 40% larger than the open area which would be provided, for example, by a conventional hand-held, ball-type brush or comb device. The turbinate arrangement and the features of the vanes and their disposition provide flow paths of discharged air having continually varying and spiraling radii about the axis of air flow through, or about the central axis of the internal chamber of the hair styler, and provide spaces or gaps of varied and wide circumferential and radial extent between adjacent vanes. The pressurized hot air which builds up in the internal chamber is accelerated through the gaps between adjacent vanes, and along the concavely shaped internal surfaces of the vanes, such that the discharged hot air is spun out from the central portion of the vanes in a turbulent manner. The turbinate arrangement of the vanes, their features and disposition, and the rounded or ball-shape of the hair styler which cooperate to evacuate air quickly and efficiently from the interior of the hair styler are significant because the operating temperatures of hot air hair blowers and hair styler attachments are close to the temperature limits of many non-metal materials which might be used for the hair styler. If the air is not rapidly and efficiently exhausted, the excessive build up of pressurized heated air in the internal chamber could rapidly overheat and tend to melt or soften such materials of the hair styler. Also, for hair stylers made of non-metal or metal materials, the excessive build up of air pressure in the internal chamber would resist incoming air and the fan in the hair blower, and could rapidly overheat the hair blower.

It is within the scope of this invention that the hair styler of the invention can be comprised of deflector means, preferably vanes, which themselves or with a minimal structural base or skeletal framework, would provide or form the coupler means and/or the internal chamber of the hair styler. The vanes can of any suitable type, size, shape or disposition, for example, as employed in various turbine or louver apparatus, so long as they provide the plurality of exterior flow paths P as disclosed herein. The hair styler can be made of one or a plurality of pieces, and although it can be made of any suitable material or combination of materials, the preferred material for the preferred embodiments of the vanes described herein is an elastomeric material, such as the thermal plastic elastomer (TPE), which is commercially available from Monsanto Polymer Products Company under the trade designation "Santoprene".

From the foregoing description, it is evident that main features of the hair styler of this invention include a turbinate arrangement of vanes to rapidly and efficiently discharge air from the hair styler, the features and disposition of the vanes, and the discharge of air from the hair styler in plural flow paths P which are substantially transverse or perpendicular to central axis CA of the internal chamber, and which manifest in different angular directions about such axis. Another main feature of the invention is that the air discharged from one vane is directed over, preferably at shallow angles over, and through the prongs on the outer surface of an adjacent vane to thereby provide above-mentioned advantages of air flow along, rather than perpendicular to the lie of hair strands among the prongs. Another main feature is that, due to the preferred longitudinally concave shape of the vanes, air is discharged in a spinning, turbulent manner from a central portion of the concavely shaped elongated vanes, to thereby render the hair styler capable of providing additional lift and volume to hair.

Having thus described the hair styler of this invention with particular reference to preferred embodiments thereof, it will be apparent that various changes and modifications may be made therein without departing from the spirit and scope of the present invention as defined in the appended claims.

What is claimed is:

1. A hair styler for controlling a flow of air emitted from a hair blower, which comprises:

coupler means for attachment to the hair blower and, when so attached, aligned to receive air emitted along an axis of flow of the hair blower, and deflector means associated with the coupler means for deflecting the air that flows through the coupling means into plural flow paths exterior of the hair styler, said plural flow paths being approximately transverse to and about the axis of flow, and manifesting different angular directions about said axis of flow.

2. The hair styler of claim 1 wherein the deflector means include a plurality of canted vanes connected to the coupler means, the vanes being spaced from each other and disposed about the axis of flow, and having an exterior surface with a plurality of prongs extending outwardly therefrom for manipulating hair.

3. The hair styler of claim 2 wherein the coupler means include an internal chamber having a central axis for receiving the air emitted from the hair blower, the internal chamber having vents to allow air to exit the chamber, and wherein the vanes are disposed exterior of the vents, for deflecting the air exiting the vents into said plural flow paths.

4. The hair styler of claim 3 wherein the deflector means include a deflector in the internal chamber for deflecting the received air through the vents in flow paths which are approximately perpendicular to the axis of flow.

5. The hair styler of claim 3 wherein the vanes have an interior surface which is disposed at a non-perpendicular angle to a line drawn approximately perpendicular to the axis of flow.

6. A hair styler for controlling a flow of air emitted from a hair blower, which comprises an internal chamber with a central axis and an entrance for receiving along the central axis, air emitted from the hair blower, the internal chamber having vents to allow the air to exit the internal chamber, coupler means for attachment of the internal chamber to the hair blower such that air emitted from the hair blower is received along the central axis of the internal chamber, and deflector means associated with the internal chamber for deflecting the air exiting the vents into plural flow paths exterior of the hair styler, the plural flow paths being approximately perpendicular to the central axis of the internal chamber, and manifesting different angular directions about the central axis of the internal chamber.

7. The hair styler of claim 6 wherein the deflector means includes a deflector located in the internal chamber for deflecting the received air from its axial path and for directing it to exit the vents in flow paths approximately perpendicular the central axis of the internal chamber, the deflector means also including a plurality of canted vanes disposed about the exterior of the internal chamber in the flow paths of the air exiting the vents, for deflecting the air exiting the vents to flow in said exterior plural flow paths, the vanes having an exterior surface with a plurality of elongated members extending outwardly therefrom for manipulating hair.

8. The hair styler of claim 7 wherein the vanes are disposed adjacent one another such that the air deflected from one vane flows over an adjacent vane.

9. The hair styler of claim 7 wherein the vanes are spaced from one another to allow some of the air exiting the vents to be discharged from the hair styler through the spaces between the vanes.

10. The hair styler of claim 7 wherein the vanes are disposed at a non-perpendicular angle relative to the central axis of the internal chamber.

11. The hair styler of claim 7 wherein the internal chamber has an entrance end, and a blind end wall opposite the entrance end, and the deflector means includes the blind end wall.

12. The hair styler of claim 7 wherein the vanes are disposed at a non-perpendicular angle relative to the central axis of the internal chamber, and the vanes are elongated and, as viewed from their exterior, they are disposed generally longitudinally along the central axis of the internal chamber.

13. The hair styler of claim 12 wherein the elongated vanes have an interior surface which is concavely shaped relative to the internal chamber, when viewed in section taken vertically through and along the length of the elongated vanes.

14. The hair styler of claim 7 wherein the vanes have an interior surface which is disposed at an angle when the vanes are viewed in section taken perpendicularly through and across a width dimension of the vanes.

15. The hair styler of claim 12 wherein the elongated vanes have an interior surface which is disposed at an angle when the vanes are viewed in section taken perpendicularly through and across a width dimension of the vanes.

16. The hair styler of claim 7 wherein the vanes have a leading edge facing in the direction of the air flow deflected from the vanes, and a trailing edge opposite the leading edge, and wherein the leading edges of the vanes are more removed from the central axis of the internal chamber than are the trailing edges of the vanes.

17. The hair styler of claim 12 wherein the elongated vanes have longitudinal side edges comprised of a leading side edge facing in the direction of the air flow deflected from the vanes, and a trailing side edge opposite the leading side edge, and wherein the leading side edges of the vanes are more removed from the central axis of the internal chamber than are the trailing side edges of the vanes.

18. The hair styler of claim 12 wherein the elongated vanes are approximately conically shaped when viewed along their lengths, and relative the central axis of the internal chamber.

19. The hair styler of claim 12 wherein vanes have a longitudinal center line which is curved.

20. The hair styler of claim 12 wherein, when the vanes are viewed from their exterior, the center lines of the respective vanes intersect the central axis of the internal chamber.

21. The hair styler of claim 17 wherein portions of the leading and trailing side edges of the elongated vanes are curved in general correspondence with the curve of center lines of the vanes.

22. The hair styler of claim 17 wherein the exterior of a portion of the hair styler formed by the vanes is generally in the shape of a segment of a circle, the leading side edges of the vanes are disposed along the periphery of the segment of the circle, and the trailing side edges of the vanes are disposed radially interior of the segment of the circle.

23. The hair styler of claim 12 wherein the vanes are disposed in a turbinate arrangement about the central axis of the internal chamber.

24. The hair styler of claim 23 wherein vanes are made of an elastomeric material.

25. A hair styler for attachment to a hair blower, comprising:

coupler means for attaching the hair styler to the hair blower, an internal chamber having a central axis for receiving in a path along the central axis, air emitted from the hair blower, means disposed in the internal chamber for changing the path of the air received along the central axis and causing the air to flow in paths which are substantially transverse to the central axis of the internal chamber, and an array of vanes which are disposed in a turbinate arrangement about the central axis of the internal chamber, the vanes being disposed at a non-perpendicular angle to and in the paths of the air traveling in said substantially transverse flow paths, such that said traveling air which impinges on the vanes is directed to flow in plural flow paths exterior of the vanes which are substantially transverse to, and angular about the central axis of the internal chamber.

26. The hair styler of claim 25 wherein the vanes have an exterior surface with prongs extending outwardly therefrom, and the plural exterior flow paths are through prongs of said adjacent vanes.

27. The hair styler of claim 26 wherein vanes are made of an elastomeric material.

* * * * *